US006633323B2

(12) United States Patent
Beaufort

(10) Patent No.: US 6,633,323 B2
(45) Date of Patent: Oct. 14, 2003

(54) VISUAL CHECK WINDOW FOR PRINTING PERFORMANCE AND/OR TONER STATUS

(75) Inventor: Richard F. Beaufort, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 3 days.

(21) Appl. No.: 09/973,238

(22) Filed: Oct. 9, 2001

(65) Prior Publication Data

US 2003/0067532 A1 Apr. 10, 2003

(51) Int. Cl.[7] ..... B41J 2/47
(52) U.S. Cl. ..... 347/240; 347/251
(58) Field of Search ..... 347/245, 240, 347/251, 263, 107; 358/1.9; 399/49; 101/93

(56) References Cited

U.S. PATENT DOCUMENTS 5,761,996 A * 6/1998 Gauthier et al. ..... 101/93
5,995,714 A * 11/1999 Hadley et al. ..... 358/1.9
6,068,374 A * 5/2000 Kurata et al. ..... 347/108
6,115,561 A * 9/2000 Fukushima ..... 399/49

* cited by examiner

*Primary Examiner*—Hai Pham

(57) ABSTRACT

Apparatus and methods for test printing are described for computer printer or other printers, including multi-pass engines or other engines. A test pattern may be printed on a non-consumable material preferably inside the printer and is made viewable by an onlooker either by the non-consumable being stationary and in view of a window/door, or moveable to the window/door after the test pattern is printed. Preferably, the test pattern is printed on an electrophotographic print engine intermediate transfer, so that printing quality produced by the entire width of the photoconductor and transfer member is diagnosed. By viewing the test pattern image, a user may see whether all toners or inks are printing properly, preferably whether all are printing without significant defects and are all aligned. Once the temporary test pattern is viewed or when a new print job is requested, the system cleans the test pattern off of the transfer member. The invented system preferably does not involve the use of any consumable paper or other sheet media, so that paper is saved, and, if the test pattern is small, toner or ink is also saved, compared to conventional full-page test pattern printing.

19 Claims, 5 Drawing Sheets

VISUAL CHECK WINDOW FOR PRINTING PERFORMANCE AND/OR TONER STATUS

BACKGROUND OF THE INVENTION

1. Field of the Invention

This invention relates generally to printing devices, such as laser printers or ink-based printers, and, especially, to color printers. More particularly, this invention relates to apparatus and method for improved printing tests, for example, testing for toner/ink availability, defects such as streaks or fading, and, preferably, alignment of colors relative to each other. The invention relates to systems for saving the paper on which test patterns are conventionally printed. Also, the invention may be adapted to save other consumables, notably, by reducing the amount of toner or ink used for test patterns.

2. Related Art

Conventionally, test patterns are printed by printers, as requested or as preprogrammed, to indicate toner availability and printing quality. A test page usually comprises a pattern, logo, and/or data over most of a page, which shows: whether all colors of toners are available and operable, whether all colors are printing without detects, and whether the four primary colors are aligning properly to form proper patterns and color-tones that are necessary for high quality color printing. Many computer and printer systems include options for setting the frequency of test page printing, for example, once before every print job, or only upon request. Typically, a test page is also automatically printed each time a printer is restarted after being turned off or after a power failure. Each time a test page is printed, a sheet of paper is used, and the toner required to cover a substantial portion of the sheet is used, after which the test page is visually checked and discarded.

There is a need for reducing the waste inherent in the test page process, while maintaining the user or the repairperson's access to the information conveyed by the test page process. There is a need for an improved test process that reduces, at a minimum, paper usage, while still indicating whether printing of all four toner colors is within acceptable quality limits. The present invention addresses these and other needs.

SUMMARY OF THE INVENTION

The present invention comprises apparatus and methods providing intuitive visual feedback regarding printing performance, by allowing a user or other person to look into the printer at a test pattern. The feedback does not require paper or other media to be ejected out from the printer and then thrown away. The feedback on printer performance is contained preferably entirely within the printer, and comprises only toner/ink usage. The invented test printing system gives feedback on printer performance preferably at least in some or all of the following areas: toner/ink availability, and whether the developer(s) or cartridge(s) are printing without significant defects and with the colors properly aligned.

Preferably, the invented test printing system provides this visual feedback preferably without requiring opening of the printer or removing any parts from the printer. The invented system provides a preferably non-disposable, nonconsumable test print surface that is positioned, or movable to be, in a user's view through an opening in the housing. Preferably, in cases where the test print surface is movable, it moves automatically during the test operation, after the test pattern is printed, to be in view of the window or doorway. The opening is preferably a transparent window, which allows viewing of the test pattern without exposing the test print surface to the outside environment, or, less preferably, the opening may be a doorway covered by a movable door.

In a preferred embodiment for a color laser printer, a test "patch" is printed on the intermediate transfer belt and positioned behind/below a window through the printer housing so that the user/repairperson may look through the window at the test patch. The test patch preferably is not transferred to paper, but only resides on the transfer belt for a specified duration until the toner is wiped off the transfer belt and disposed of in the waste toner receptacle inside the printer.

In an ink-based printer, such as an HP Inkjet® printer, there is typically no transfer belt or other intermediate image-carrying member, because ink is applied directly onto paper during either normal printing or test page printing. Therefore, an ink-style embodiment of the present invention provides a test surface, inside the printer, on which the cartridge prints the test patch. The test surface is positioned in, or moves into, view through a window provided through the printer housing, for viewing of the test patch by the user. Alternatively, the test surface is easily seen by the user upon opening a door in the housing to reveal the test surface. As in the preferred laser printer embodiments, the test patch resides on the test surface for a specified duration until the toner is wiped off the test surface and disposed of in a waste toner receptacle inside the printer.

In ink-based printers, the ink cartridge may be adapted to move to the test surface for printing of the test pattern, and then to move away from the test surface to reveal it to someone looking through a window or doorway. Alternatively, the test surface of an ink-based printer may be adapted to move between various locations, that is, typically from an ink-receiving position adjacent the ink cartridge, to a display position, and then to a cleaning position.

The test patch is designed to be a size and pattern sufficient to show the user, at a minimum, whether all colors are printing. Additionally, the size and pattern are preferably sufficient to show whether there are defects, such as streaking or fading, in any of the color areas, and whether the colors are properly aligned so that the pictures of many color tones will result from the four primary toner colors. Preferably, the test patch is approximately as wide as the developers, photoconductor, and transfer belt, to show print quality across a full-page-width.

DETAILED DESCRIPTION OF THE INVENTION

Referring to the Figures, there are shown several, but not the only, embodiments of the invented print quality diagnostic system for printers. The invented print testing apparatus and methods are preferably applied to laser printers, but may also be applied to Inkjet® or other ink printers.

A color laser printer typically includes an intermediate transfer member, such as a transfer belt, which, during normal printing operation, receives the toner image created by all four conventional colors, black, magenta, yellow, and cyan. In the preferred embodiment of the invention, this transfer member receives the test pattern, but does not transfer it onto paper or other media. Instead of transferring the test pattern, the transfer belt moves the test pattern to a still position adjacent to an opening in the housing, for example, a window or a doorway, through which the test pattern is visible to a viewer. Preferably, the transfer belt moves the test pattern area of the belt to near the window or doorway, which means a distance close enough for users to see the test pattern clearly, preferably about ½–5 inches, and more preferably about ½–2 inches.

In an ink-based printer, because of the lack of any intermediate transfer member, a test-print surface is supplied so that the test pattern may be printed on that surface and then viewed through a window or doorway by the viewer. The ink-based printer test surface and test patch may be smaller in area than the test surface and test patch of the preferred electrophotographic embodiments. Because the ink printer has no developer roller, photoconductor, or transfer belt to be, in effect, tested for print quality by means of a wide test patch, a smaller test surface and test patch may suffice.

In either style of printer, paper usage is reduced, and, if the test pattern is made smaller than a full-page test pattern, toner consumption per test pattern is also reduced. The printer may be pre-programmed to produce the test pattern at selected times, for example, before each print job, upon request by the user, and/or upon start-up of the printer. The printer programming and controls may be designed to require printing of the test pattern at certain times, or to allow the user to select or de-select options for test pattern printing. Alternatively, the printer may be programmed and adapted to print a small test pattern at certain times, and to print a larger, more complex test pattern on paper at certain times. This dual-mode operation may be beneficial for service and maintenance, and the mode may be pre-programmed to occur at certain times or after/before certain activities, or may be selected by the user, or both. For example, the printer may print the small paperless test pattern upon demand by the user or when no printing has occurred for a predetermined amount of time, while the printer may print the large paper test pattern upon start-up of the printer.

Figure 1:
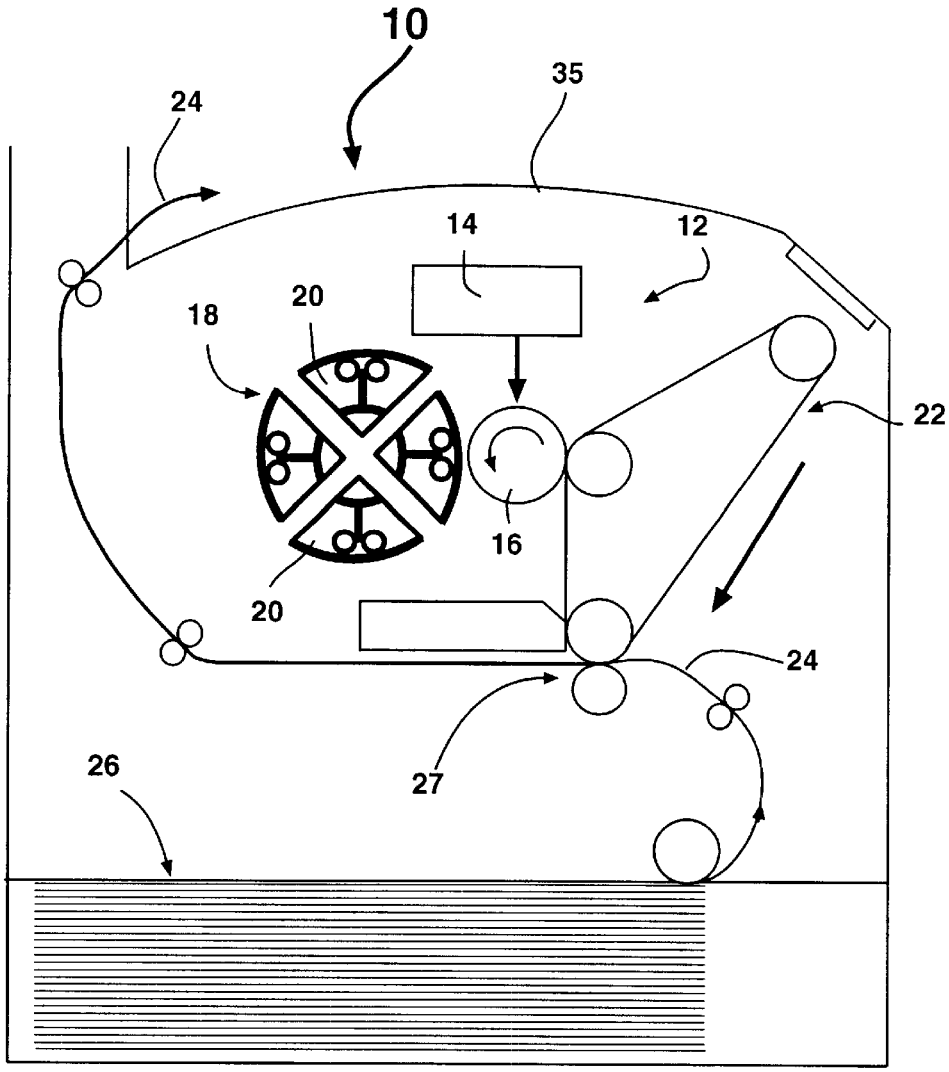
FIG. 1 is a schematic side view of the internal workings of one embodiment of a multi-pass, color laser printer that includes an embodiment of the present invention wherein a user may look through a window at a test patch on a transfer belt, wherein the printer is operating in test page mode.

Referring to FIG. 1, there is shown a color printer 10 with a multi-pass print engine 12. This engine 12 includes a laser writing station 14, a photoconductor drum 16, and a carousel 18 of four color toner developers 20. In multiple-passes, the photoconductor drum 16 transfers four single-color images onto a transfer belt 22, so that the four images are superimposed to make a desired final image. During normal printing operation, illustrated in FIG. 1, paper 24 or other sheet media is picked from the paper tray 26 and moved to the transfer station 27, where the final image is transferred to the paper 24 for fusing downstream of the transfer station 27. The paper 24 with its fused image is ejected from the printer for access by the user. This process also represents the steps for conventional test page production, wherein the laser writes a conventional, large test pattern, and the ejected page contains a four-color test pattern for viewing by the user.

Figure 2:
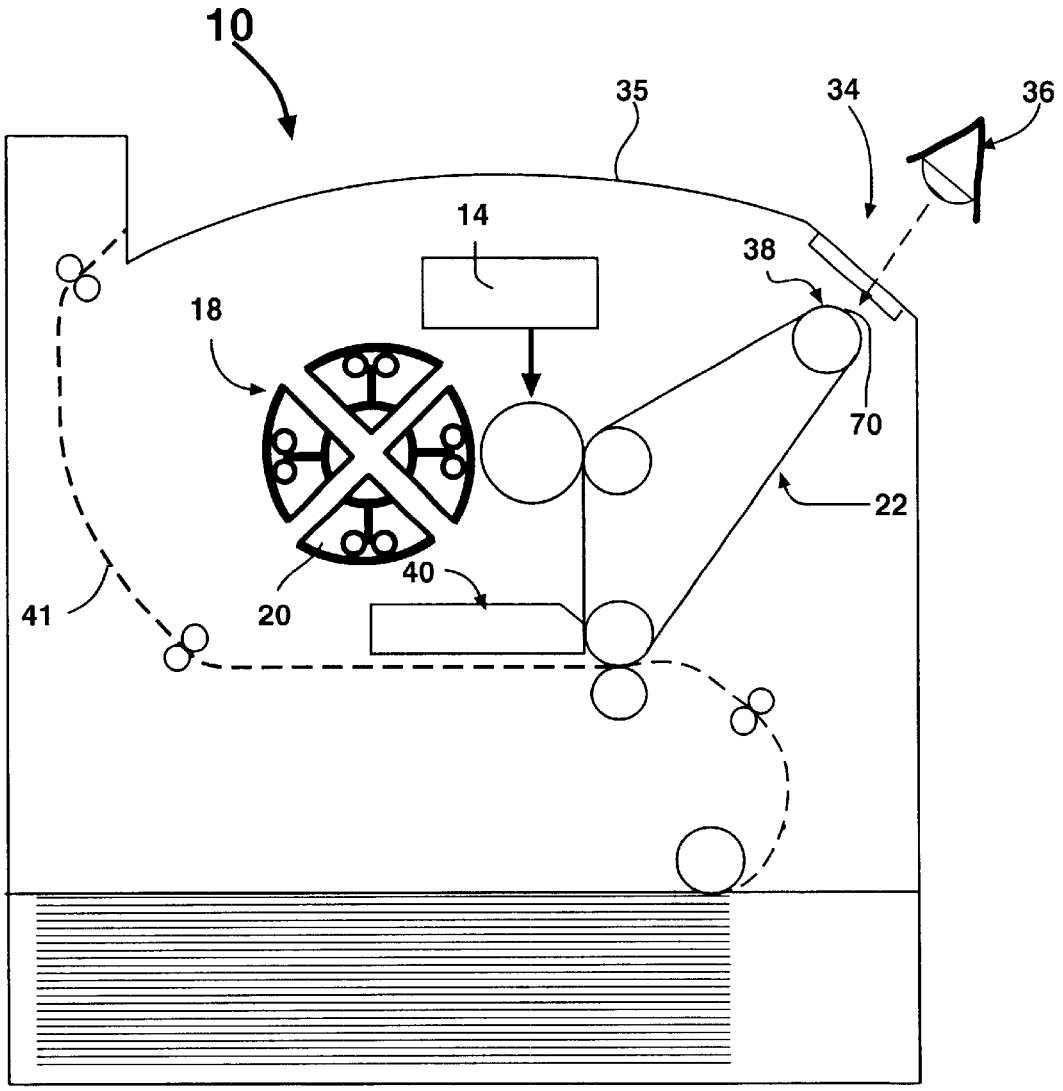
FIG. 2 is a schematic side view of the printer of FIG. 1, operating in test patch mode according to one embodiment of the invention.

FIG. 2 illustrates the multi-pass print engine of FIG. 1, operating in a "test patch" mode, rather than "test page" mode, that is, producing a test patch 30 of colors on the transfer belt 22 but not transferring it to paper. The printer 10 includes a window 34 through the housing 35, wherein the window 34 is positioned so that the transfer belt 22 may move to place the test patch 30 directly under the window 34, for viewing by a user 36 or repair-person. After a predetermined amount of time, the transfer belt 22 may move the area 38 of the belt that holds the test patch through the cleaning station 40 to remove the test patch from the belt. This predetermined amount of time may be, for example, a few minutes after the user has requested the test patch, or at the time a new print job or test patch is requested. As illustrated in FIG. 2, when the printer test system is operating in test patch mode rather than test pattern mode, there is no paper traveling in the paper path (dashed lines 41), but the laser 14, carousel 18, photoconductor 16, transfer belt 22, and print engine/printer programming cooperate to produce the test patch for viewing at the window 34. The programming may be programming code means in printer firmware or in other computer-readable media such as CD, disks, tape or other media.

Figure 3:
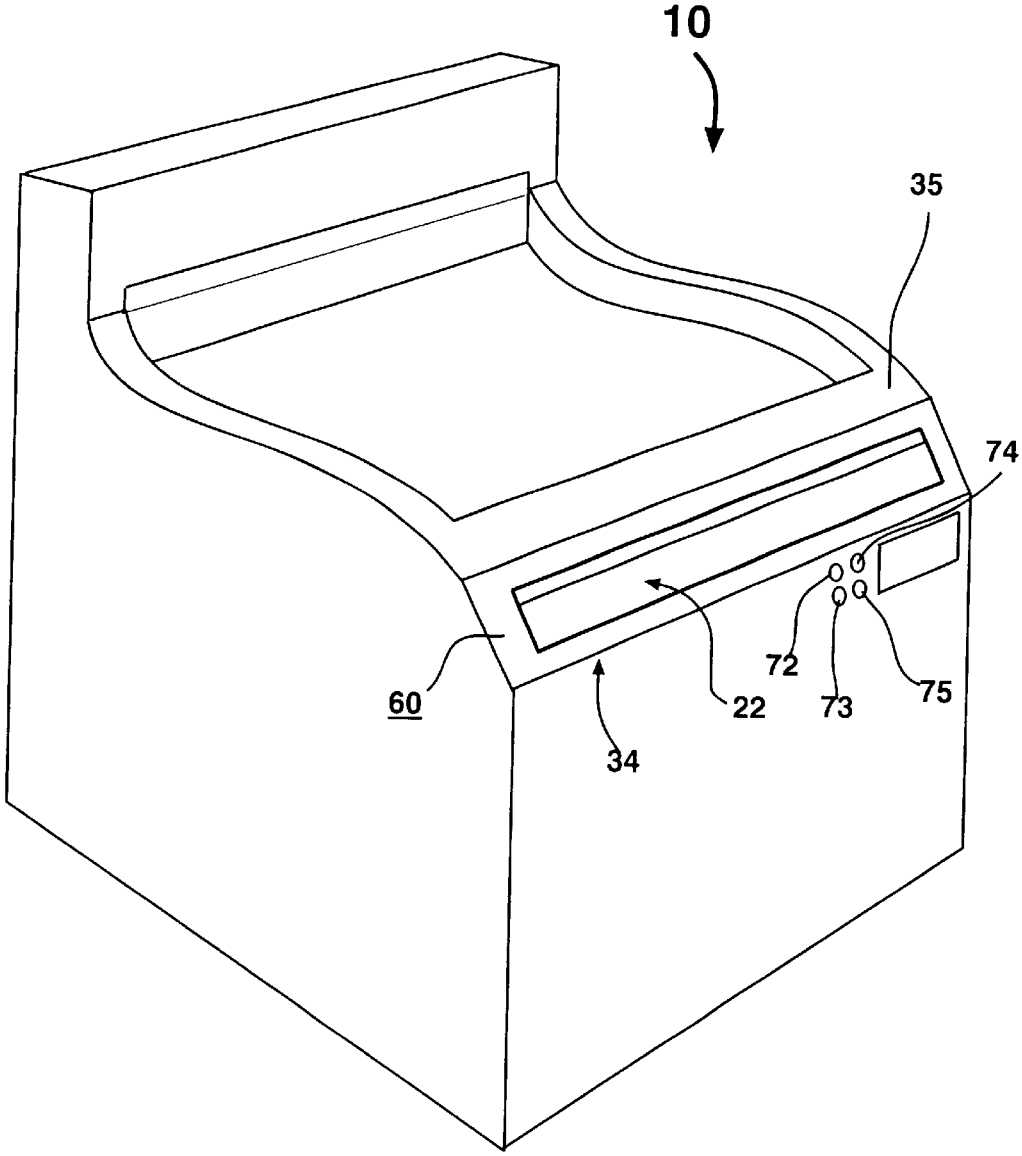
FIG. 3 is a schematic, front perspective view of one embodiment of a printer including a test patch-viewing window according to an embodiment of the invention.
Figure 4:
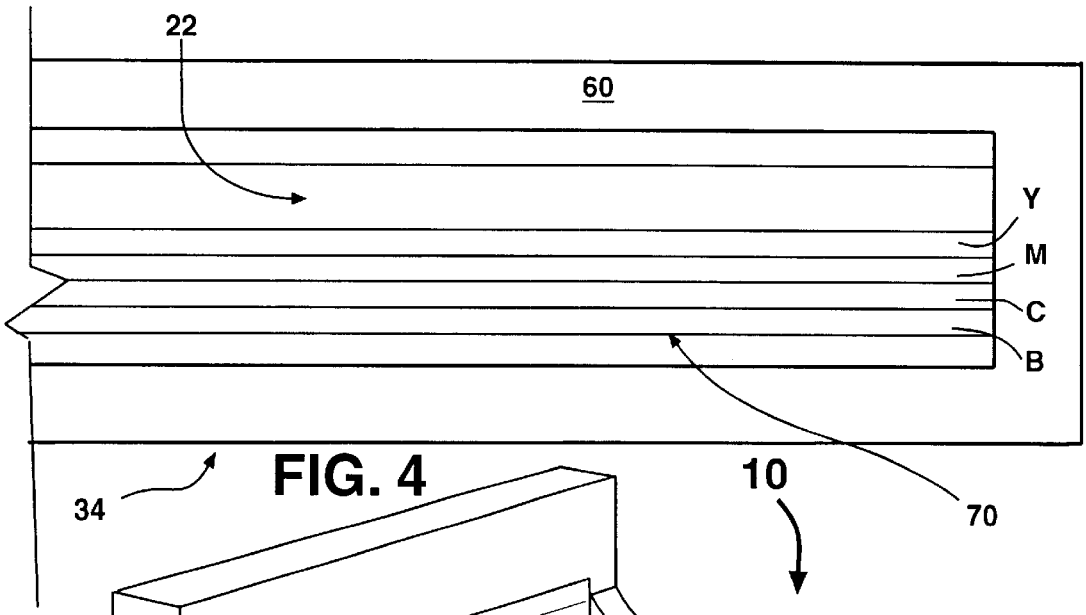
FIG. 4 is a schematic partial detail view of the window of FIG. 3, through which is seen a transfer belt and one embodiment of a test patch with four color strips.

FIGS. 3 and 4 illustrate an outer housing 35 of a printer including one of many possible embodiments of the invention. Window 34 is positioned on a housing surface 60 generally facing upwards and forward, for easy viewing by a user. Through the window 34 may be seen a portion of the transfer belt 22 on which is printed the test patch 70. Near the window may be buttons and various control devices and/or indicators and lights. One or more of the buttons or indicators may operatively/electronically/electrically connect to the programming code means used for controlling the test patch and/or test page processes, and indicating the status of the processes. One of the switches ("button 72"), for example, may be a switching means for the user to request a test patch. The same button 72, when pressed a second time, may signal that the user has viewed the test patch and wishes the test patch to be cleaned from the belt. Corresponding lights or indicia 74 may indicate what steps are being requested or carried out in response to operation of the button 72. Alternatively, the switches/buttons and programming may be adapted so that, after a test patch is requested, printed and available at the window for a specified amount of time, a separate button 73 must be pushed to move the test patch for belt cleaning, with corresponding indicia 75. Or, another embodiment would adapt the printer code to automatically move the test patch away from the window to the cleaning station or other position, after a specified amount of time, or immediately before each print job.

As illustrated in FIG. 4, one of many possible test patches 70 could be as simple as strips of color, preferably four parallel strips/stripes (black B, cyan C, magenta M, and yellow Y), each of a different one of the four colors. These strips would be printed of a size and position that would sufficiently indicate to the user whether all four colors are printing properly and in an alignment that indicates that normal printing will take place with sufficient quality. In effect, the four long, parallel stripes can indicate whether developers, photoconductor and transfer belt are all performing well across their entire widths. Other test patches may be other patterns, such as other geometric shapes, typeface, logos, or lines that are judged by the designers of the printer to be indicative of performance, and that will be easily interpretable by a user. Alternatively, there may be several patterns that may be alternated, or manually selected by a user or serviceperson to impart particular information to the particular viewer.

Preferably, as illustrated in FIGS. 3 and 4, the window 34 and the test patch 70 viewed through the window 34, extend substantially the entire width of the printer, which corresponds to approximately the entire width of a page of paper. For example, for most printers, the window 34 width is approximately 8–9 inches wide, to display stripes all the way across standard sizes of paper.

Figure 5:
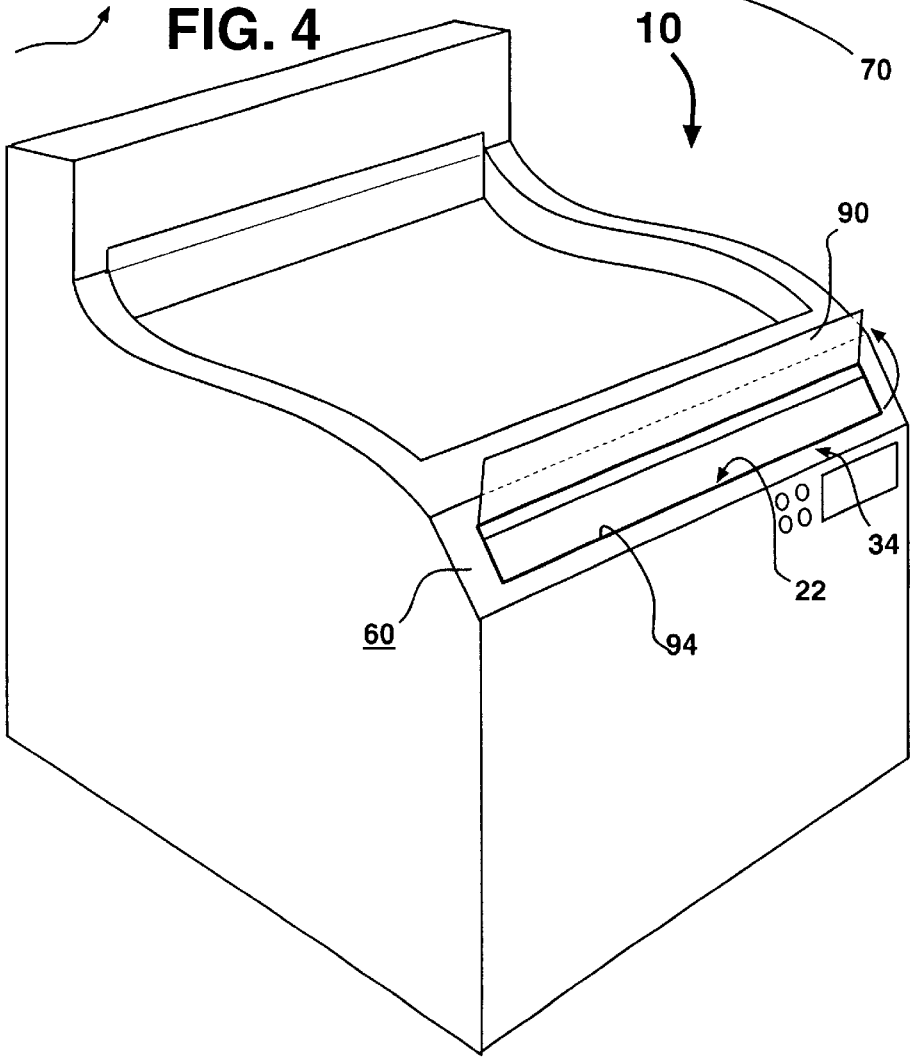
FIG. 5 is a schematic, front perspective view of another embodiment of a printer including a test-patch viewing door system, shown with the door open for viewing the transfer belt.

While the preferred embodiments include a window of transparent material covering an opening into the housing, FIG. 5 illustrates a printer housing that includes a door 90 over an opening ("doorway") 94 in the housing surface for revealing the transfer belt 22 and the test patch 70 printed thereon. With this system, the transfer belt 22 is not normally visible, until the user purposely opens the door 90 for direct viewing of the test patch. The invented system is designed so that movement or removal of other printer parts is not necessary to see the test patch. As with the window, the door system is non-intrusive and non-interfering with operation, except that no printer operation and no printer parts movement will occur when the door is open. This way, the door 90 into the housing and the opening 94 do not pose a danger to anyone viewing the printer.

Alternatively, a combination of door system and window may be used, for example, a hinged or sliding door with a window in it. This way, many users may only look through the window at the test patch, while others who desire/ need a closer, less-obstructed look may open the door to view the test patch.

Figure 6:
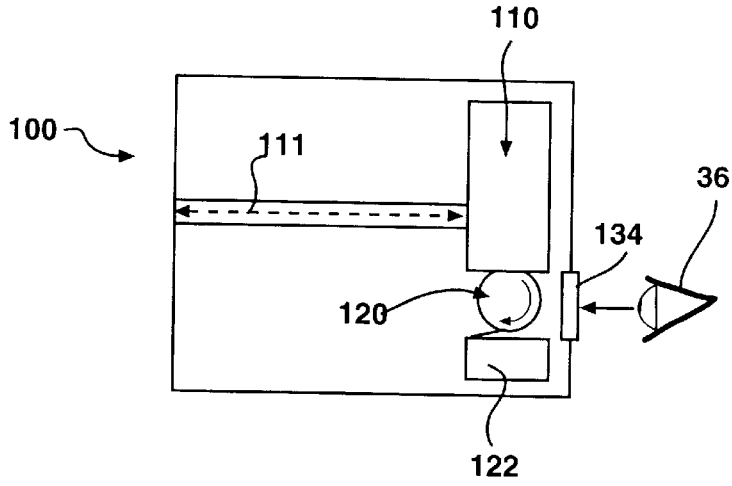
FIG. 6 is a schematic front view of the internal workings of a jet-style printer, according to one embodiment of the invention, wherein a movable test surface is viewed through a side window.

An alternative embodiment in FIG. 6 illustrates an embodiment that adapts an ink printer 100 for test patch operation mode. Cartridge 110 may travel laterally beyond its normal printing path (111) to a test patch printing location, wherein the cartridge 110 may print a test patch on belt 120. The normal printing path 111 may also be called herein "a transverse path" because of the ink cartridge's normal movement back and forth across the width of a page of paper to print an image. After printing of the test patch on belt 120, the belt may move to a window 134 for example, in the side of the housing where a user may view the test patch. Then, for normal printing, the cartridge moves to its normal printing location/path. In preparation for another test patch, the belt may move through a cleaning station 122 and around to the test patch printing position. Alternative embodiments may include a drum, roller, or other moving surface, in the place of the belt 120.

Figure 7A:
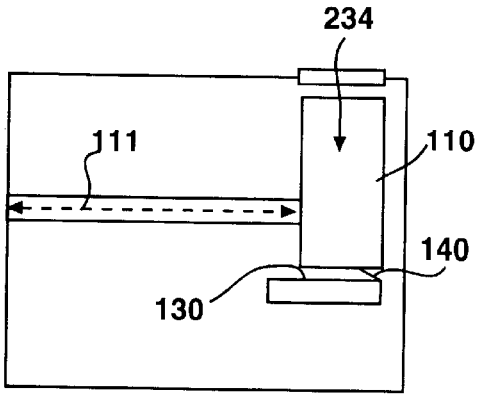
FIG. 7A is a schematic front view of the internal workings of a jet-style printer according to another embodiment of the invention, wherein an ink cartridge moves across the test surface to wipe clean the test surface and print a test pattern.
Figure 7B:
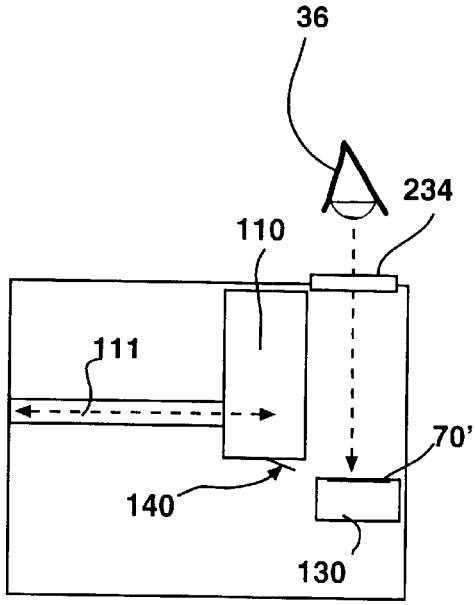
FIG. 7B is a schematic front view of the embodiment of FIG. 7A, wherein the ink cartridge has moved away from the test surface to reveal the test pattern to a user.

Another alternative embodiment of an ink printer is shown in FIGS. 7A and 7B. A stationary test surface 130 is provided in a position inside the printer to which the ink cartridge may move for test patch printing. Preferably, the test surface is generally planar, and near the end of the ink cartridge's normal transverse printing path. When a test patch is requested or pre-programmed, the ink cartridge 110 moves across, and prints the test patch on, the test surface, as in FIG. 7A. The ink cartridge 110 then moves to the side, preferably to its normal printing or resting position (path 111) as shown in FIG. 7B revealing the test patch 70' on the test surface. With the cartridge out of the way, the test patch 70' is visible through a window 234 above the test surface or through a doorway when a lid/door (not shown) is raised.

To clean a test patch off of the test surface in the embodiment in FIGS. 7A and B, a wiping blade 140 may be supplied on the ink cartridge or associated structure that wipes the previous test patch off of the test surface prior to printing of the subsequent test patch. For example, this may be done by providing a wiping blade 140 that wipes the test surface only during one direction of movement, that is, when the ink cartridge moves toward the test surface prior to a new test patch being printed, but not when the cartridge moves away from the test surface.

One may see, from the above description of preferred embodiments for laser jet printer and ink printers, that various "test surfaces" may be used for receiving the test print toner or ink. In laser printer embodiments, the intermediate transfer belt or other transfer member is preferred as a test surface, because a transfer belt/member is already positioned for receiving a toner image and adapted to move the printed surface away from the photoconductor to other areas within the housing. In an ink printer, an alternative test surface may be supplied, because an intermediate transfer belt/member is typically not supplied. The term "test print surface" may therefore include transfer belt/members provided for and operative in the normal printing operation, or test surfaces that are provided only for test print operation.

The term "printing" may include various image-transfer operations, including electrophotographic operations and ink jet/spray operations, or other processes. Likewise, the term "image-forming material" may include toner, ink, or other fluids, powders, or marking materials that form images on a sheet of printing media.

Although this invention has been described above with reference to particular means, materials and embodiments, it is to be understood that the invention is not limited to these disclosed particulars, but extends instead to all equivalents within the broad scope of the following claims.

What is claimed is:

1. A print test system for testing print quality in a printer having a housing, the system comprising:

a test print surface inside the housing of the printer positioned to receive a test pattern of image-forming material; and a window through the housing for viewing the test pattern;

wherein the test print surface is adapted to be near the window so that at least a portion of the test print surface s visible to a user through said window from outside the printer, and wherein the test print surface is not paper.

2. A system as in claim 1, wherein the image-forming material is selected from a group consisting of toner and ink.

3. A system as in claim 1, wherein the test print surface is adapted to be near the window by being positioned stationary near the window.

4. A system as in claim 1, wherein the test print surface is adapted to be near the window by being movable to the window.

5. A system as in claim 1, wherein the test print surface is an intermediate transfer member in an electrophotographic printer.

6. A system as in claim 1, wherein the test print surface is a stationary surface near an end of an ink cartridge transverse path in an ink-based printer.

7. A system as in claim 1, wherein the test print surface is a moving surface near an end of an ink cartridge transverse path in an ink-based printer.

8. A system as in claim 1, further comprising a computer-readable programming code means that causes the test pattern to be printed on the test print surface and the test print surface to move to near the window so that the test pattern is visible through the window by a user.

9. A system as in claim 8, wherein said programming code means comprises means for the test pattern to b printed on the test print surface upon demand by a user.

10. A print test system for a printer having a housing, the system comprising:

a test print surface inside the housing of the printer positioned to receive an image-forming material;

a test pattern of image-forming material printed on the test print surface; and an opening in the housing with a door, the opening being for viewing the test pattern inside the printer;

wherein the test print surface is adapted to be near the opening so that at least a portion of the test print surface is visible to a user through the opening when said door is opened, so that the test pattern is visible the user, and wherein the test print surface is not paper.

11. A system as in claim 10, wherein the test print surface is adapted to be near the opening by being positioned stationary near the opening.

12. A system as in claim 10, wherein the test print surface is adapted to be near the opening by being movable to the opening.

13. A system as in claim 10, wherein the test print surface is an intermediate transfer member in an electrophotographic printer.

14. A system as in claim 10, wherein the test surface is a stationary surface near an end of an ink cartridge transverse path in an ink-based printer.

15. A system as claim 10, wherein the test surface is a moving surface near an end of an ink cartridge transverse path in an ink-based printer.

16. A system as in claim 10, further comprising a programming code means that causes the test pattern to be printed on the test print surface.

17. A method of testing print quality in a printer having a housing, the method comprising:

providing a test print surface inside the housing;

causing a test pattern of image-forming material to be placed on said test print surface; and providing an opening into the housing so that a user outside the printer sees, through the opening, the test pa em on the test print surface inside the printer;

wherein the test pattern is not printed on disposable media.

18. A method as in claim 17, further comprising a transparent window material covering the opening, so that the user sees the test pattern through the window material.

19. A method as in claim 17, further comprising a door covering the opening, so that the user opens the door to look through the opening at the test pattern.

* * * * *

UNITED STATES PATENT AND TRADEMARK OFFICE

CERTIFICATE OF CORRECTION

PATENT NO. : 6,633,323 B2
DATED : October 14, 2003
INVENTOR(S) : Richard F. Beaufort It is certified that error appears in the above-identified patent and that said Letters Patent is hereby corrected as shown below:

Column 6,
Line 58, delete “s” and insert in lieu thereof -- is --;

Column 7,
Line 16, after “to” delete “b” and insert in lieu thereof -- be --;
Line 30, after “visible” insert in lieu thereof -- to --;

Column 8,
Lines 23 and 24, delete “pa” and “em” and insert in lieu thereof -- pattern --.

Signed and Sealed this

Third Day of February, 2004

JON W. DUDAS
*Acting Director of the United States Patent and Trademark Office*